US005532423A

United States Patent [19]

Liu

[11] Patent Number: 5,532,423

[45] Date of Patent: Jul. 2, 1996

[54] DYNAMIC DRIVING STRUCTURE FOR THE ORNAMENTAL MUSIC BOX

[76] Inventor: Jian H. Liu, No. 2, Alley 202, Kao Fen Road, Hsin-chu, Taiwan

[21] Appl. No.: 350,895

[22] Filed: Dec. 7, 1994

[51] Int. Cl.[6] ..... G10F 1/06

[52] U.S. Cl. ..... 84/95.2; 74/50; 40/411; 446/298; 446/330

[58] Field of Search ..... 84/95.1, 95.2; 74/50; 446/298, 330; 40/411, 414, 415

[56] References Cited

U.S. PATENT DOCUMENTS 5,430,238 7/1995 Chen ..... 84/95.2

*Primary Examiner*—Patrick J. Stanzione
*Attorney, Agent, or Firm*—Larson and Taylor

[57] ABSTRACT

The present invention is related to a dynamic driving structure for the ornamental box comprising an eccentric shaft, a link rack driven by the eccentric shaft, a bracing pedestal used for supporting the link rack and other components, wherein the link rack is a tabulate plastic, and two grooves separated with a space are formed on the middle thereof so as to make the link rack flexible. The ends of the link rack are connected with the bracing pedestal to form a rectangle, and the other two grooves are formed on the junctions between them. Moreover, the end of the eccentric shaft on the music bell is rotated between the two side walls of the link rack, so the link rack is driven to perform a swinging phenomenon.

13 Claims, 6 Drawing Sheets

DYNAMIC DRIVING STRUCTURE FOR THE ORNAMENTAL MUSIC BOX

FIELD OF THE INVENTION

The present invention provides a dynamic driving structure for the ornamental box, and it particularly provides the dynamic phenomena of extending and withdrawing an adornment which extends outside the ornamental box from the driving structure.

BACKGROUND OF THE INVENTION

Attention has been directed to the general dynamic driving structure for an adornment of an ornamental music especially to the structure which takes the eccentric shaft of the music bell as the source for driving the relevant components to achieve dynamic phenomena of the spherical or cubical adornment. For example, U.S. patent application Ser. No. 08/277303 by the same inventor discloses a structure which drives the rack by the eccentric shall of the music bell so that the circularly swinging phenomenon of the swinging slick attached on the rack is performed.

In the aforementioned application the dynamic phenomenon performed by the swinging slick is a circular swing, the characteristic of such structure is obviously not a parallel movement, so it is useless for the case where a dynamic phenomenon of parallel movement is needed.

SUMMARY OF THE INVENTION

In view of the application described above, the primary object discussed in this invention is how to achieve the phenomenon of parallel movement for the spherical or cubical adornment by a simple structure. In a specific embodiment of this invention, the structure comprises an eccentric shaft which extends from a music box that provides the driving force and a link rack driven by the eccentric shaft. A bracing pedestal is used for supporting the link rack and other components. In this invention the link rack is a tabulate plastic, and two spaced grooves are formed on the middle thereof so as to make the link rack flexible. The ends of the link rack are connected with the bracing pedestal to form a rectangle, and the other two grooves are formed on the junctions between them.

Moreover, the end of the eccentric shaft on the music bell is rotated between the side walls of the link rack, so the link rack is driven to swing.

DETAILED DESCRIPTION OF THE PREFERRED EMBODIMENTS

Figure 1:
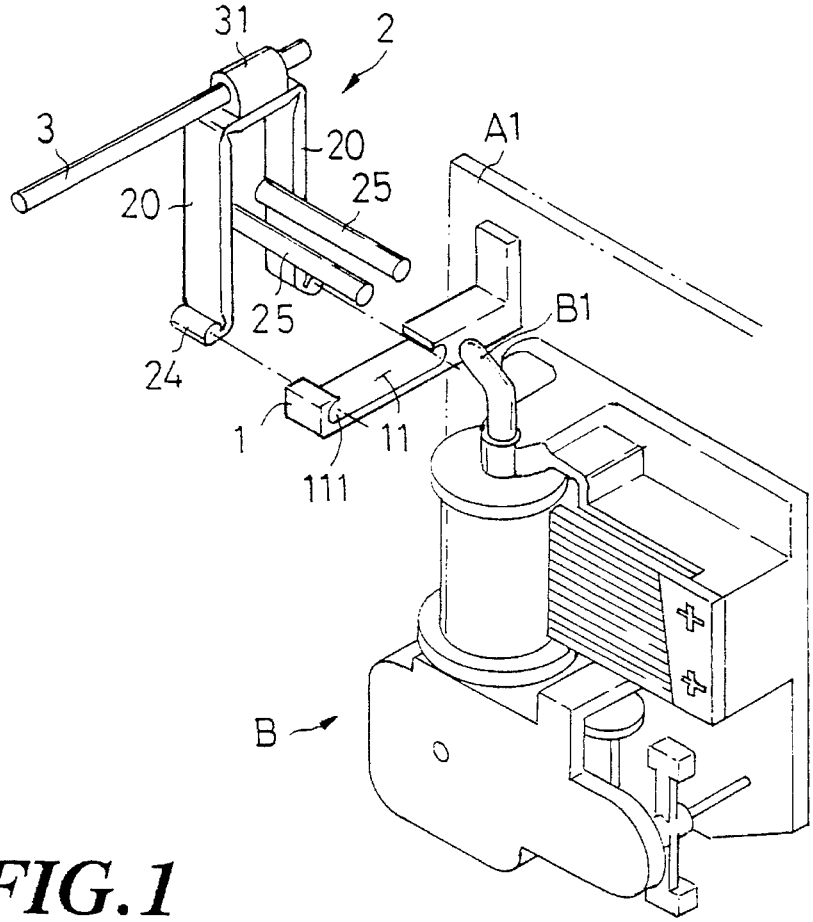
FIG. 1 shows a perspective view of the construction according to this invention.
Figure 2:
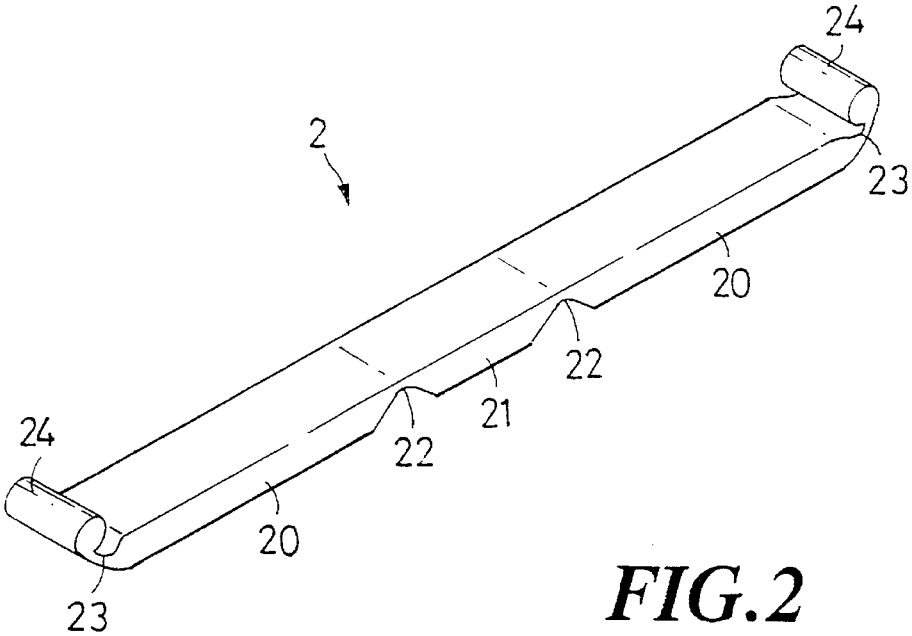
FIG. 2 is an extension diagram of the link rack in FIG. 1.
Figure 3:
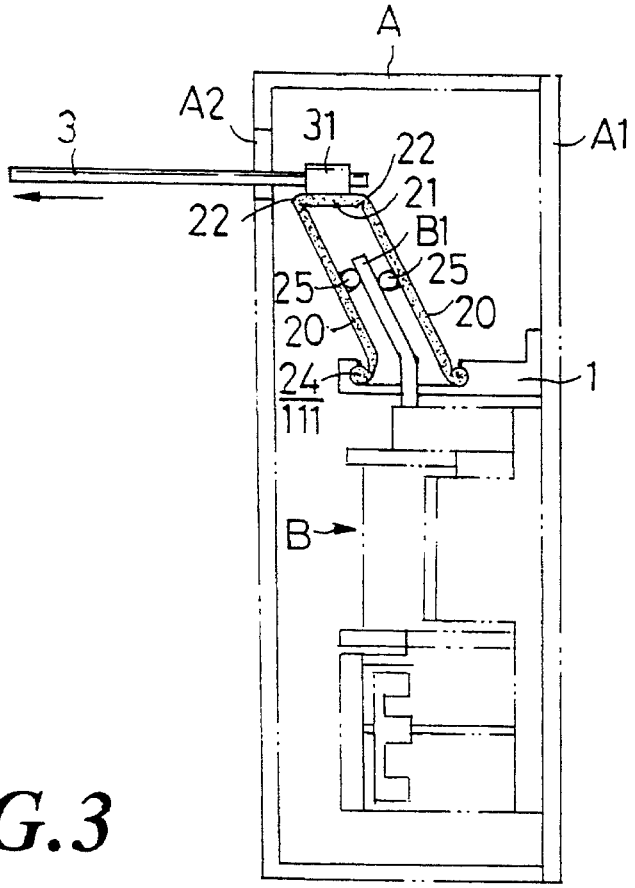
FIG. 3 is a side view of FIG. 1, it demonstrating the extending phenomenon of the extending slick formed from the link rack being driven to incline to one side by the eccentric shaft.
Figure 4:
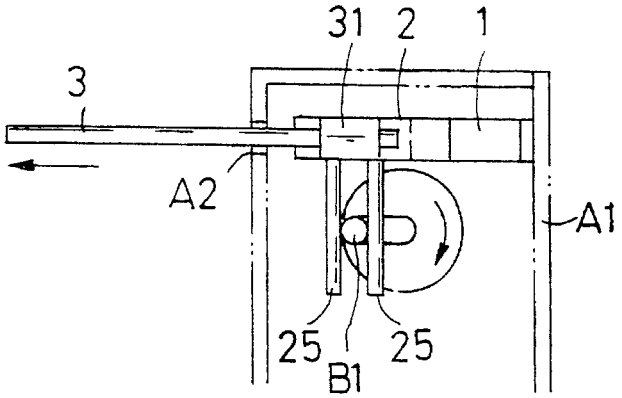
FIG. 4 is a top view of FIG. 3, it disclosing the relative placement between the eccentric shaft and the accessory stick of the link rack.

As illustrated in FIGS. 1 and 3, there is a back cover (A1) on the box (A), a music box or bell (13) driven by spring is installed thereon, so the music bell (E1) is located inside the box (A). An eccentric shaft (B1) is installed on the music bell (13), and it is driven to perform a rotary phenomenon as the music bell (B) is started. Moreover, a link rack (a) produced by tabulate plastic is arranged as shown in FIG. 2, two grooves (22,22) formed on the middle thereof are thinner in thickness, so the regions of the grooves (22) are flexible and elastic. By the characteristic of the link rack (2) described above, it can be bent to become a shape of a rectangle according to the grooves (22,22) or relaxed to recover the original tabulate shape. Besides, two similar grooves (23,23) are formed on the ends of the link rack, and two cylindrical or rectangular tenons (24,24) are also formed on the ends thereof. The upper end (21) of the link rack (2) is defined by the flat region between the grooves (22,22), and the two side walls (20,20) are defined between the grooves (22,23).

Moreover, a bracing pedestal (1) is mounted or stuck on the back cover (A1) aside the eccentric shaft (B1) of the aforementioned music bell, a built-up groove (11) the width of which is equal to the space of the grooves (22,22) is formed thereon, and the shape of the groove (111) formed on both sides of the built-up groove (11) is the same with that of the tenon (24) on the link rack. Front the design of the bracing pedestal (1), it is known that the tenons (24,24) on the ends of the link rack (2) are suitable for engaging with the grooves (111,111) of the built-up groove (11) after the link rack (2) is bent to become a shape of a rectangle according to the grooves (22,22), so the link rack (2) can be supported on the bracing pedestal (1) by the engagement between the tenon (24) and the built-up groove (11).

The shape of the link rack (2) supported on the bracing pedestal (1) is rectangular, the regions of the grooves (22,23) on the corners of the rectangle are flexible, so it forms a four sides connection of parallelogram in reality. Therefore, the upper end (21) of the link rack (2) can be swung leftwards and rightwards.

Figure 5:
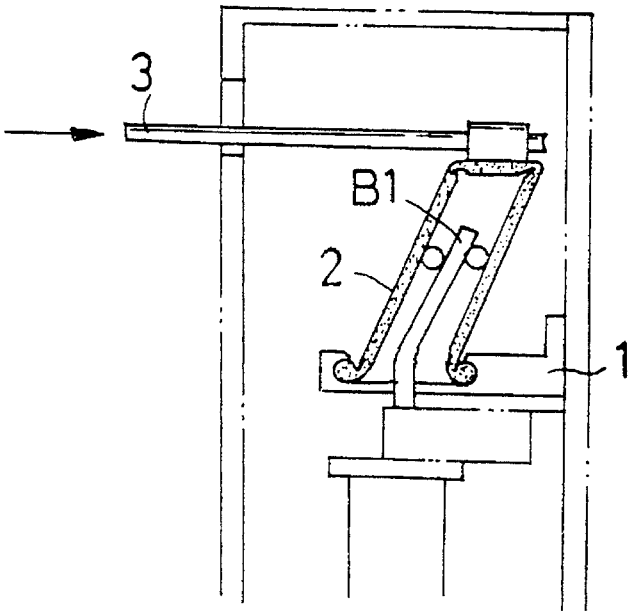
FIG. 5 is a side view of FIG. 1, it demonstrating the withdrawing phenomenon of the extending stick formed by the link rack being driven to incline to the other side by the eccentric shaft.
Figure 6:
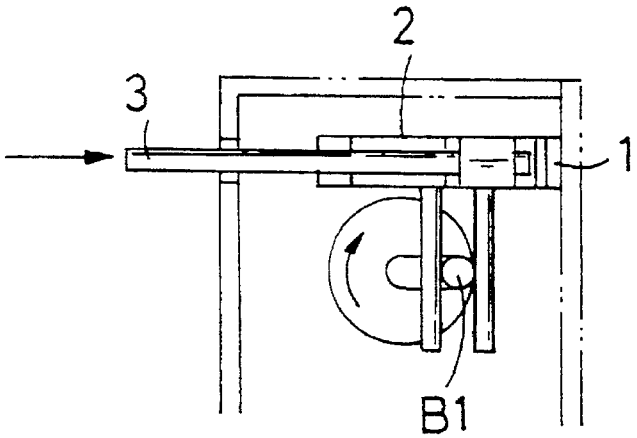
FIG. 6 is a top view of FIG. 5, it disclosing the relative placement between the eccentric shaft and the accessory stick of the link rack.

Furthermore, the height of the end of the eccentric shaft (131) is on the middle of the side wall (20) of the link rack, two elastic accessory slicks (25,25) are extended from the side wall (20) of the link rack (2) to the eccentric shaft (B1) and the space between them is slightly larger than the diameter of the eccentric shall (B1). The end of the eccentric shaft (B1) is located between the accessory sticks (25,25) so the link rack (2) is pushed to swing leftwards and rightwards by the accessory stick (25) as illustrated in FIGS. 3 or 5, when the eccentric shaft (B1) is driven to rotate by the music bell.

Because the link rack (2) is driven to swing horizontally by the eccentric shaft (B1), we can stick a axle seat (31) on the upper end (21) thereof and an extending stick (3) passing the aperture (A2) of the box is fastened on the axle seat (31), then the adornment on the end of the extending slick (3) performs dynamic phenomena of extending and withdrawing by the swing of the link rack (2). The swinging amplitude of the extending stick (3) is amplified by increasing the vertical height of the axle seat (31) in accordance with the height of the box (A) and the practical need.

Figure 7:
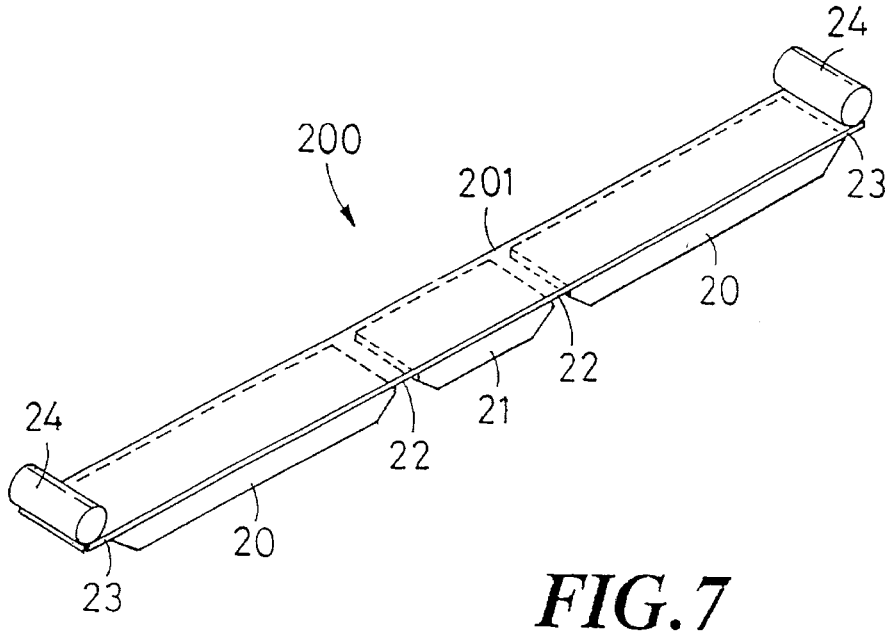
FIG. 7 is an extension diagram of an alternative embodiment of the link rack.

The aforementioned link rack is not limited to be produced by monoblock, the alternative embodiment is shown in FIG. 7. The link rack (200) in this embodiment is formed by a soft film (201) which the hard plastics are stuck on at the positions with respect to the upper end (21) and the side walls (20,20) the tenons (24,24) are also stuck on the ends of the film (201). The side walls are arranged separately with the upper end (21) and the tenon (24), so the regions between them automatically have the same effect with the grooves (22,23) described above.

Figure 8:
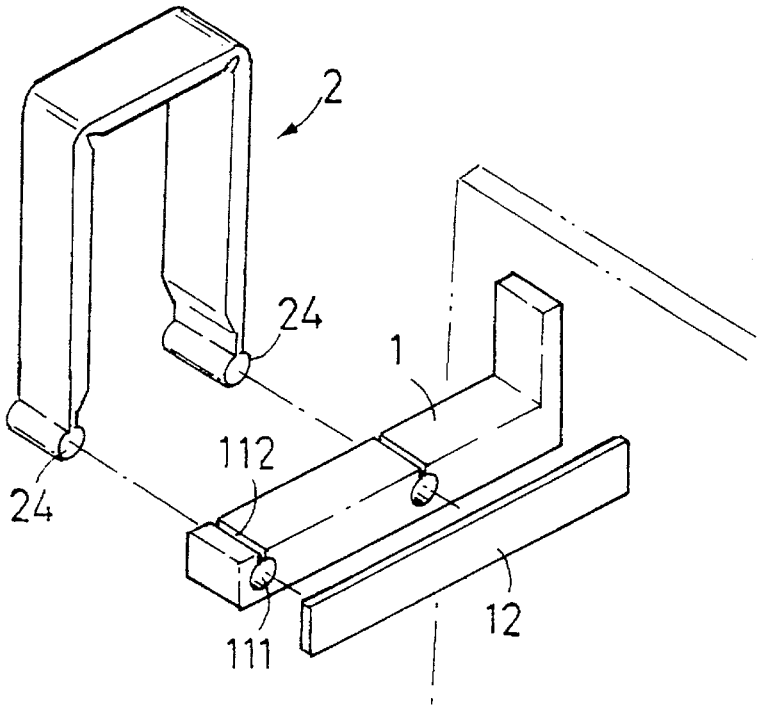
FIG. 8 is a perspective view that shows the embodiment of the bracing pedestal which the locating boards are installed on both sides thereof.
Figure 9:
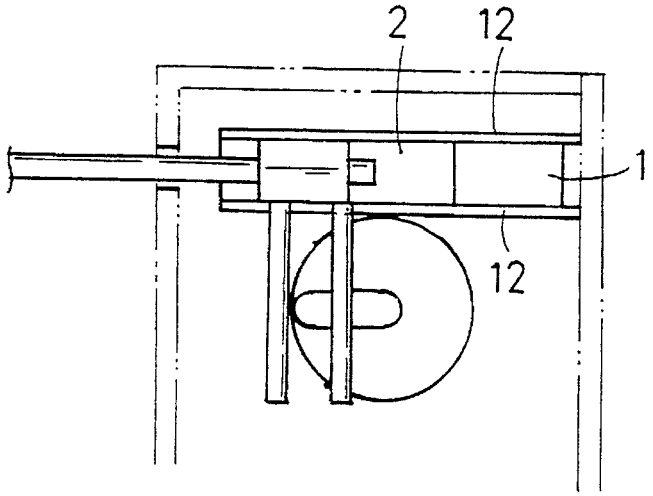
FIG. 9 is the top view of FIG. 8, it disclosing the relative placement between the bracing pedestal and the locating boards.

Because the tenon (24) of the link rack (2) is engaged laterally with the bracing pedestal (1), the locating boards (12,12) extended from the back cover (A1) of the box are installed on both sides of the aforementioned built-up groove (11) of the bracing pedestal to avoid the link rack (2) being disengaged from the bracing pedestal (1) in operating, as shown in FIGS. 8 and 9, then the link rack (2) is restricted and located. Moreover, the built-up groove (11) of the bracing pedestal (1) is not limited to be the shape of open state as shown in FIG. 1, it is better that the groove (111) and the rabbet (112) are formed on the place with respect to the tenon (24) and the groove (23) of the link rack, then the tenon is restricted and the upward disengagement thereof is avoidable.

Figure 10:
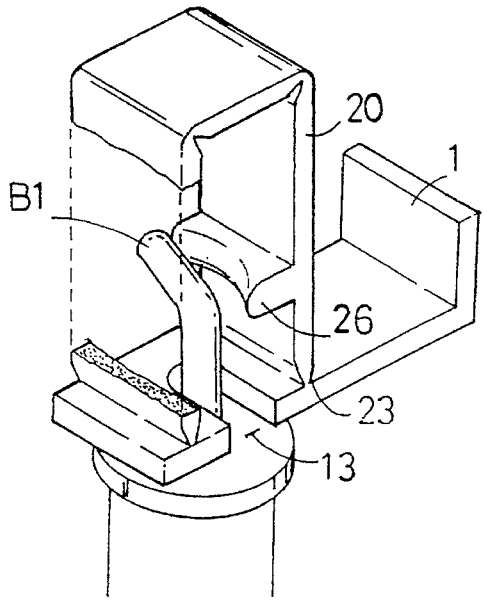
FIG. 10 is a perspective view of an alternative embodiment of the bracing pedestal and the link rack.

The link rack (2) described above is engaged with the bracing pedestal (1), in FIG. 10 the link rack (2) and the bracing pedestal (1) are produced together by ejection modeling for saving the work of assembly and the link rack (2) is still have the same characteristic.

Figure 11:
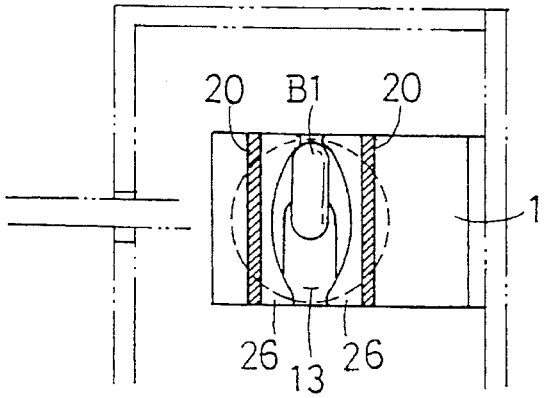
FIG. 11 is the top view of FIG. 10, it disclosing the placement of bracing pedestal and the link rack with respect to that of the eccentric shaft.

The bracing pedestal (1) and the link rack (2) of the aforementioned embodiment are arranged on one side of the eccentric shaft (B1), it is necessary for installing an accessory stick (25) extended from the side wall (20) of the link rack (2) to the eccentric shaft (B1), but there is no restriction about the arrangement of them. The alternative embodiment as illustrated in FIGS. 10 and 11 shows a different structure. A slot (13) with a width larger than the diameter of the eccentric shaft (B1) is formed on the central position of the bracing pedestal (1) with respect to the eccentric shaft (B1), then the bracing pedestal (1) can be arranged upon the eccentric shaft (B1) through the slot (13) and the end of the eccentric shaft (B1) is located between the side walls (20,20) of the link rack (2). Besides, maybe the space between the side walls (20,20) is larger than the rotation diameter of the eccentric shaft (B1), the convex block (26) which has the same function with the aforementioned accessory stick (25) is installed on the side wall (20) at the position with respect to the end of the eccentric shaft (B1) so as to make the link rack (2) be driven effectively by the eccentric shaft (131), and the length of the convex block (26) is approximately equal to the rotation diameter of the end of the eccentric shaft (B1). The space between the convex blocks (26,26) is gradually getting small when the link rack (2) swing leftwards and rightwards, so the surface of the convex block (26) is made to be concave and curved in order to keep the end of the eccentric shaft (B1) touch it when the link rack (2) is swinging.

Figure 12:
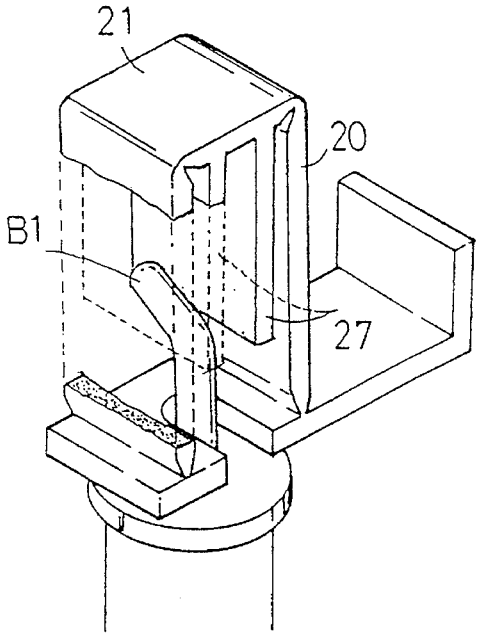
FIG. 12 is a perspective view of an alternative embodiment of the elastic lamella extended longitudinally from the upper end of the link rack.
Figure 13:
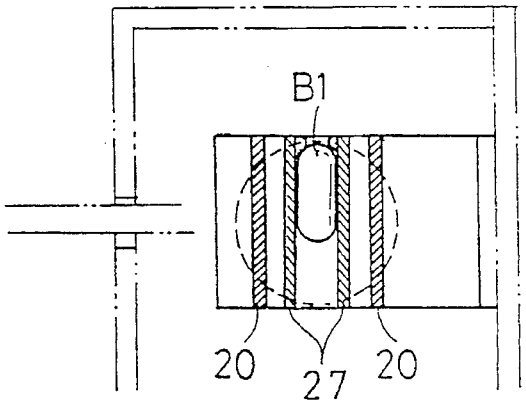
FIG. 13 is the top sectional view of FIG. 12, it disclosing the placement of the elastic lamella with respect to that of the link rack and the eccentric shaft.

Except the embodiment of the convex block (26) described above, the alternative embodiment with the structure which has the same function with the accessory stick (25) is shown in FIGS. 12 and 13. In this structure, two elastic lamellas (27,27) extended longitudinally from the upper end (21) of the link rack to the position with respect to the height of the end of the eccentric shaft (B1) are installed and the space therebetween is approximately equal to the diameter of the eccentric shaft (131). Because the end of the elastic lamella (27) is flexible, the characteristic of getting small in the space therebetween during the link rack (2) swinging is absorbed by this flexibility. Moreover, the flexibility of the elastic lamella (27) is larger than that of the link rack (2), so it is practicable for the link rack (2) being driven to swing by the eccentric shaft (B1) through the elastic lamella (27).

Summarize the foregoing description, the link rack is driven to swing horizontally by the eccentric shaft through the combination of the link rack and the bracing pedestal, wherein the link rack is produced by a plastic monoblock, the grooves are formed on the setting place thereof, so it forms a four sides connection of parallelogram in reality.

What is claimed is:

1. A dynamic driving structure for an ornamental box that has a music box, the driving structure comprising an eccentric shaft driven by the music box, an elongate link rack driven by said eccentric shaft, and a bracing pedestal used for supporting said link rack said link rack is a tabulate member having two spaced grooves located therein thereby defining a middle portion of said link rack therebetween and two end portions, each said end portion having a terminal section that extends outwardly from a further groove in said link rack, said spaced grooves making said link rack flexible;

said terminal sections of said link rack are engaged with said bracing pedestal so as to form three sections of a parallelogram shape with said end portions forming the side walls thereof; and a portion of said eccentric shaft on said music bell is rotated between said end portions of said link rack, so that said link rack is driven to swing.

2. The structure as claimed in claim 1, wherein said link rack is formed by a soft film on which hard plastic pieces are mounted at the positions with respect to the middle portion and said side walls of said link rack.

3. The structure as claimed in claim 2, and further including locating boards extended from the box and which are located on both sides of said conforming surfaces of said bracing pedestal.

4. The structure as claimed in claim 1, wherein said terminal sections are tenons that are formed on the ends of said link rack and said bracing pedestal has conforming surfaces to said tenons so as to be engaged therewith.

5. The structure as claimed in claim 4 wherein said tenons are mounted on the ends of said film; and said side walls are arranged separately with said middle portion and said tenons.

6. The structure as claimed in claim 4, and further including locating boards extended from the box and which are located on both sides of said conforming surfaces of said bracing pedestal.

7. The structure as recited in claim 1, wherein said link rack and said bracing pedestal are produced together from a monoblock.

8. The structure as recited in claim 1, wherein said bracing pedestal is located on one side of said eccentric shaft of said music box.

9. The structure as claimed in claim 8 where an elastic accessory stick is extended from each said side wall of said link rack to said eccentric shaft, and a portion of said eccentric shaft is located between said accessory sticks.

10. The structure as recited in claim 1, wherein an elastic accessory stick is extended from each said side wall of said link rack to said eccentric shaft, and a portion of said eccentric shaft is located between said accessory sticks.

11. The structure as recited in claim 10, wherein a slot is formed on said bracing pedestal at the position with respect to that of said eccentric shaft so that said bracing pedestal can be arranged upon said music box, and the end of said eccentric shaft is located between said accessory sticks.

12. The structure as recited in claim 11, wherein a curved convex block which keeps in contact with the end of said eccentric shaft is installed on said side wall of said link rack at a height with respect to that of the end of said eccentric shaft and the length of said convex block is approximately equal to the rotation diameter of the end of said eccentric shaft.

13. The structure as claimed in claim 11, wherein two spaced apart elastic lamellas are extended longitudinally from said middle portion of said link rack to a position the height of which is equal to the end of said eccentric shaft, the flexibility thereof is larger than that of said link rack, and the space between said elastic lamellas is equal to the diameter of said eccentric shaft.

* * * * *